US005320349A

United States Patent [19]

Winston

[11] Patent Number: 5,320,349

[45] Date of Patent: Jun. 14, 1994

[54] CURVED POLICE BATON WITH CROSS-HANDLE

[76] Inventor: Terrence R. Winston, 6201 Curtis Rd., Upper Marlboro, Md. 20772

[21] Appl. No.: 34,823

[22] Filed: Feb. 18, 1993

[51] Int. Cl.[5] ..... F41B 15/02

[52] U.S. Cl. ..... 273/84 R

[58] Field of Search ..... 273/84 R, 84 ES; 7/166; D22/117

[56] References Cited

U.S. PATENT DOCUMENTS

| | | | |
|---|---|---|---|
| 4,052,063 | 10/1977 | Wong | 273/84 R |
| 4,203,599 | 5/1980 | Starrett | 273/84 R |
| 4,226,418 | 10/1980 | Balfour | 273/75 |
| 4,655,456 | 4/1987 | Chen Dai | 273/84 R |
| 4,765,856 | 8/1988 | Doubt | 273/75 |
| 5,118,108 | 6/1992 | Wilmoth | 273/84 R |

*Primary Examiner*—Vincent Millin
*Assistant Examiner*—William M. Pierce

[57] ABSTRACT

A police control baton which a police officer can effectively apply to control a subject by controlling his shoulder girdle, trapping his wrist behind his back, and "fulcruming" the baton's distal end upon the musculature of his buttock to "rock" back his heel on the same side as his affected shoulder and trapped wrist.

4 Claims, 2 Drawing Sheets

FIG. 4
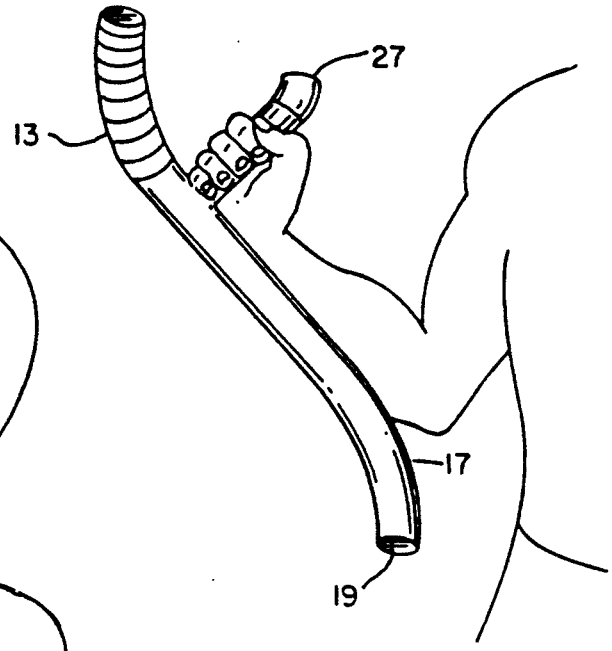
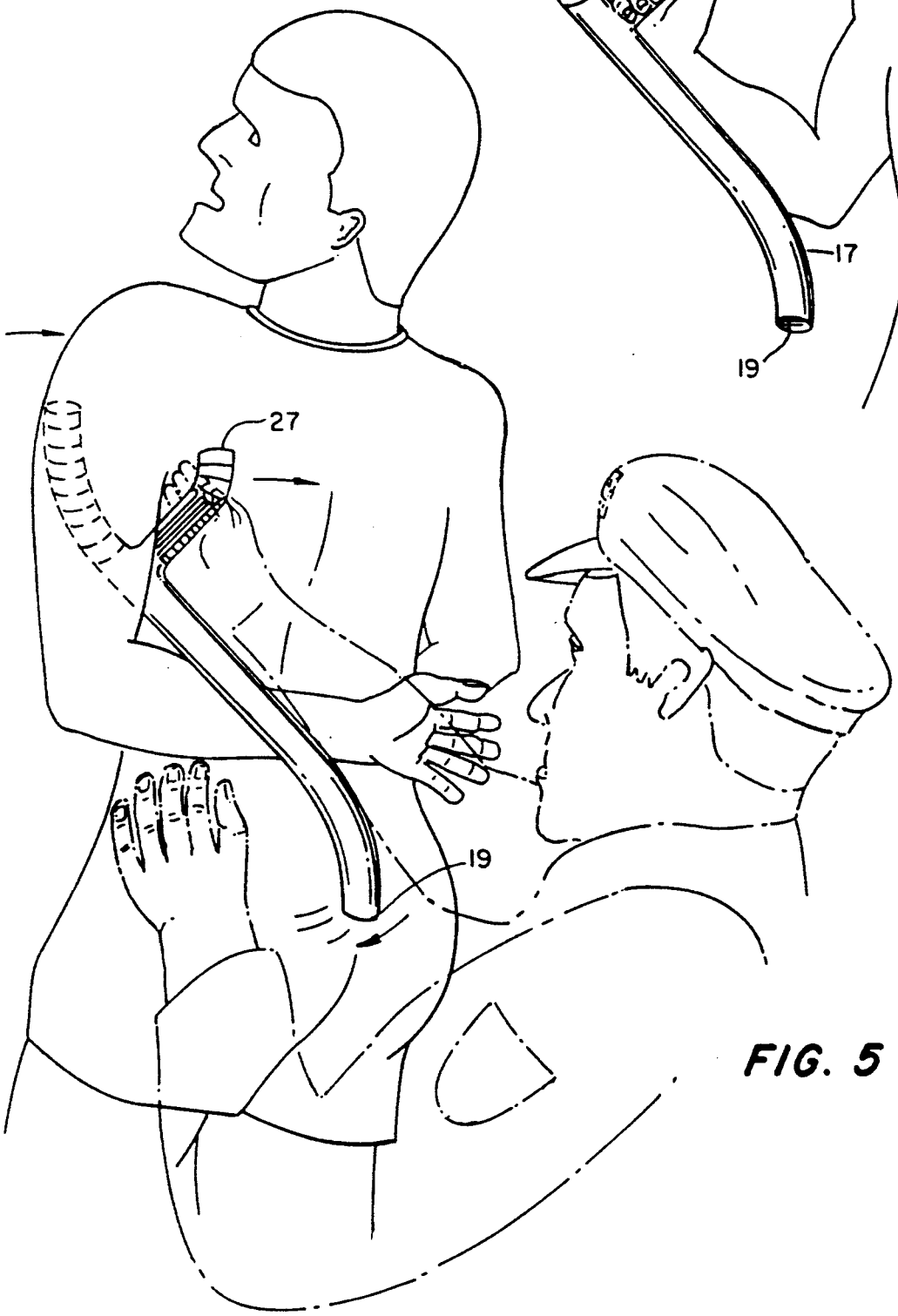
FIG. 5

CURVED POLICE BATON WITH CROSS-HANDLE

BACKGROUND OF THE INVENTION

1. Field of Invention

This invention relates to a police control baton for use by a police officer in subjecting a subject to control for arrest and apprehension.

2. Background

The problem in the art to which this invention aperatains is the need for a police control baton which a police officer can effectively apply to a subject to control such subject by controlling the subject's shoulder girdle, by trapping the subject's wrist behind the subject's back and by "fulcruming" a distal end of the baton upon the buttock's muscle surface of the subject, to "rock" the subject back on his heel on the same side as the subject's affected shoulder and wrist, thereby depriving the subject of any effective footing base from which to muster resistance and thereby rendering the subject amenable to control by the arresting and apprehending police officer.

SUMMARY OF THE INVENTION

Accordingly, the objects of the invention are to provide an effective police control baton which an arresting and apprehending police officer can apply to a subject to control the subject's shoulder girdle, to trap the subject's wrist behind the subject's back and to "fulcrum" a distal end of the baton upon the buttock's muscle surface of the subject to "rock" the subject back on his heel on the same side as the subject's affected shoulder and wrist, thereby depriving the subject of any effective footing base from which to muster resistance and thereby render the subject amenable to the police officer's control.

BRIEF DESCRIPTION OF THE DRAWINGS

These objects and other objects of the invention should be discerned and appreciated by reference to the detailed description of the preferred embodiment, taken in conjunction with the drawings, wherein like reference numerals refer to similar elements throughout the several views, in which:

FIG. 4 is a perspective view showing the baton being grasped preparatory to its intended use; and FIG. 5 is a perspective view showing the baton applied to a subject by a police officer to render the subject amenable to control.

DETAILED DESCRIPTION OF THE PREFERRED EMBODIMENT

Figure 1:
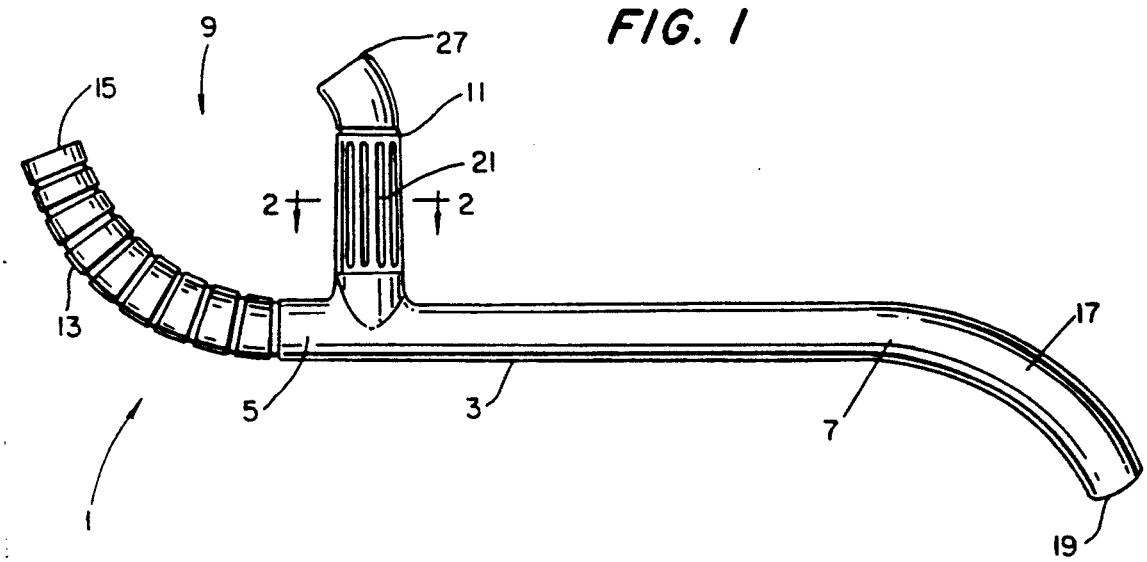
FIG. 1 is a side elevational view of the baton.

In FIG. 1 of the drawings, reference numeral 1 generally refers to the police control baton that is made of plastic material and that is of integral, one-piece construction. The continued description of FIG. 1 is predicated upon the baton being rotated 90° to its right. The baton 1 has a substantially rectilinear middle or main-body portion 3 that has an uppermost portion 5 and a lowermost portion 7. Extending upwardly from the uppermost portion 5 is a proximal Y-branched end 9, defining a first branch 11 and a second handle branch 13. The handle branch 11 is substantially normal to the uppermost portion 5 of the main-body portion 3. The second branch 13 is upstanding from the uppermost portion 5 of the main-body portion 3, and forms and defines a long-curved end that curves upwardly and terminates in its own proximal end 15. Depending from the lowermost portion 7 of the main-body portion 3 is a curved distal portion 17 that terminates in its own distal end 19. Grasped by a police officer, as viewed in FIG. 5, the police officer would view the curved distal portion 17 as curving downwardly and away from himself. With the police officer grasping the handle 11, as shown in FIG. 5, the mainbody portion 3, proximal Y-branched end 9 with its first and second branches 11 and 13, and the curved distal portion 17 would all be longitudinally viewed by the police officer as being in co-planar relationship. The handle 11 has longitudinal grooves 21; and cross-sectionally, the handle 11 of rectangular configuration with its opposite lateral sides 23 being of slightly greater length than their adjacent sides 25. The handle 11 has a round proximal end 27 that curves upwardly away from the viewing police officer and in a direction towards the second branch 13.

The baton's rectangularly configured handle 11 will mold more appropriately into the recesses of the human palm, thereby providing the police officer with a more secure grip, and especially so when the police officer is wearing gloves, or in the circumstance, otherwise, when the handle 11 is slippery. The rectangular feature of the handle 11 easily allows the police officer to maintain correct positioning and orientation of the baton 1 for operative use in a dark environment or during a scuffle with a subject by virtue of the structural fact that the very rectangular design feature of the baton's handle 11 provides the correct tactile perception for correspondingly correct positioning and orientation of the baton 1 for its intended use. Since there is no need for visual cues to ensure proper positioning and orientation of the baton, a critical time advantage is afforded the police officer to instead automatically prepare himself physically without otherwise diverting his eyes and attention from the subject, and correspondingly allowing the police officer instead to concentrate his attention to the appropriate assessment of the situation with which the police officer is confronted.

The longitudinal grooves 21 in the handle 11 will also allow the police officer to support and maintain a better grip and thereby resist torquing forces which result when displacement forces are applied to the ends of the baton 1 by a subject to be controlled.

Figure 3:
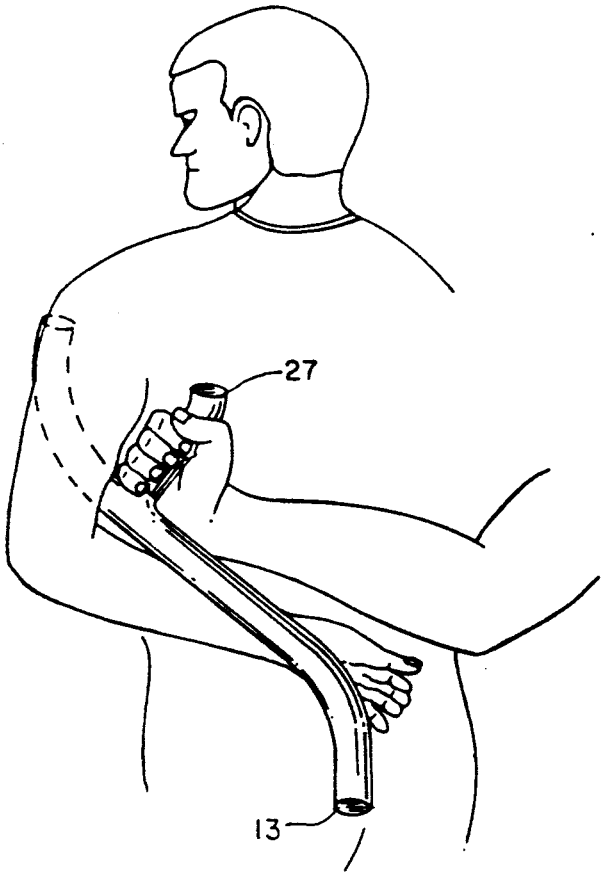
FIG. 3 is a perspective view showing the baton being applied to a subject.
Figure 2:
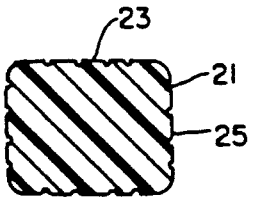
FIG. 2 is a cross-sectional view taken in the direction of the arrows 2—2 in FIG. 1.

As shown in FIGS. 3 and 5, the police officer employs the baton 1 to control the subject by controlling the subject's shoulder girdle in which the baton's second branch 13 is applied into the anterior aspect of the axilla (front of the armpit) with the second branch's remaining portion wrapping around and hugging the anterior apex (between the front and top) of the shoulder. Additionally in such control maneuver, a portion of the baton's handle 11 goes around the posterior aspect (back of the shoulder). Such described control maneuver thereby allows the hard exterior surface of the baton 1 to impinge upon the very sensitive pain fibers of the tendon sheaths, bursa and the periosteum of the bony prominences (sensitive covering of the protruding tendons, bones and capsules of the joint). In the control maneuver effected by the baton 1, the resulting accumulation of pressure against such sensitive pain fibers, per se, would render the subject compliant to the direction of the police officer's lead.

In addition to and inclusive with the preceding control maneuver, as described, the baton's curved distal portion 17 can be contemporaneously applied to trap the subject's wrist behind the subject's back with both the baton 1 and the subject's back being secured in position by pressing the distal end 19 of the baton's curved distal portion 17 into the fascial aspects of the gluteal musculature (muscle surface of the buttock area) thereby "fulcruming" the distal end 19 upon the buttock's muscle surface.

Posterior (backward) force applied by the police officer via the handle 11 and transmitted through the proximal end 15 of the second branch 13 would continue to weaken and disengage the subject's affected shoulder by hyperextending the pectoral musculature myofibrils (forcing the affected shoulder backward would stretch the muscle fibers in the chest area to the point of weakening them). By accentuating force through the baton's curved distal portion 17, all the forces so combined would be exacerbated and would "rock" the subject back on his heel (on the same side as the affected shoulder) thereby depriving the subject of an effective footing base from which to muster resistance and thereby rendering the subject amenable to further control by the police officer. Upon the police officer's effecting this described control maneuver, it will be extremely difficult physically for the subject to manually grasp the second branch's proximal end 15 to attempt to slip out of such control maneuver so effected.

The police officer utilizes his own right hand to operatively employ the baton 1 to control the subject's left shoulder girdle, maneuver the curved distal portion 17 appropriately to trap the subject's left wrist behind the subject's back and "fulcrum" the distal end 19 of the baton's curved distal portion 17 "off" the muscle surface of the subject's left buttock area, thereby preventing the subject from "wheeling around" to the subject's left to attempt to break the control hold imposed. Similarly, the police officer similarly would utilize his own left hand for controlling the subject's right shoulder girdle, for trapping the subject's right wrist behind the subject's back and for "fulcruming" the distal end 19 of the curved distal portion 17 "off" the muscle surface of the subject's right buttock area, thereby preventing the subject from "wheeling around" to the subject's right to attempt to break the control hold imposed. Whether the baton 1 is dextro-employed or levo-employed by the police officer, the control stance of the police officer vis-a-vis the subject would be physically to the left of the subject or to the right of the subject, respectively.

Another factor that significantly contributes to the police officer's maintaining the control hold imposed upon the subject is the fact that the police officer retains the option of simply applying a greater degree of posterior force upon the second branch's proximal end 15 by increasing the downward pulling force the police officer applies to the handle 11. The greater the force applied by the police officer upon the handle 11 translates into commensurately and correspondingly greater force imposed upon the affected shoulder girdle and the trapped wrist. The delicate wrist bones of the subject can only withstand a limited amount of transmitted force from the curved distal portion 17 before the subject will be subjected to intolerable excruciating pain and incapacitation.

The police officer has other inclusive control maneuver options after the baton 1 has been operatively employed as hereinbefore described. If the subject starts to wheel to attempt to break the control hold imposed and to smash the police officer with the subject's free fist, the police officer merely needs to wheel in the same direction as the subject while at the same time pulling down vigorously on the handle 11 to increase the forces being applied and transmitted to the subject's affected delicate wrist bones and shoulder girdle to stop the subject from wheeling and to impose and maintain greater control over the subject.

In a defensive upper cross block maneuver by the police officer, the curved distal portion 17 prevents a glancing blow, struck by the subject, from sliding off the curved distal end 19 of the baton 1 by "hooking" such glancing blow. The curved distal portion 17 allows the police officer to have more control over the the direction of the subject's strike by the police officer's being able to employ the curved distal portion 17 to push away the subject's striking arm, including any weapon or instrument being held and utilized by the subject in delivering such strike.

I claim:

1. A police control baton for use by a police officer to control a human subject; said baton having a main body portion with first and second ends and a cross handle extending from said main body portion nearer the first end than the second end, said first end being defined by a radius such that it is curved upward in a direction towards said cross handle and said second end being defined by a radius such that it is curved downward in a direction away from said cross handle, whereby the officer grasps the cross handle and applies the first end to the subject's shoulder to specifically wrap the first end around the shoulder's axilla with its anterior aspect, anterior apex and posterior aspect, and contemporaneously applies the second end to trap the subject's wrist behind his back.

2. A police control baton in accordance with claim 1, whereby the second end comprises means to enable the officer to exert additional control over the subject by pressing the second end into the subject's gluteal musculature to effect "fulcruming" force thereupon.

3. A police control baton in accordance with claim 1, wherein the cross handle is of rectangular configuration to afford a more secure grip and tactile preception.

4. A police control baton in accordance with claim 3, wherein the cross handle has longitudinal grooves for additional support and maintenance of the officer's grip thereon.

* * * * *